United States Patent [19]

Dornbusch et al.

[11] Patent Number: 4,641,746

[45] Date of Patent: Feb. 10, 1987

[54] TRAY-TYPE SHIPPING AND DISPLAY CONTAINER

[75] Inventors: Arthur H. Dornbusch; Roger E. Schanzle, both of Cincinnati, Ohio

[73] Assignee: The Procter & Gamble Company, Cincinnati, Ohio

[21] Appl. No.: 745,541

[22] Filed: Jun. 14, 1985

Related U.S. Application Data

[63] Continuation-in-part of Ser. No. 630,312, Jul. 12, 1984, abandoned.

[51] Int. Cl.[4] ..... B65D 5/26; B65D 5/48; B65D 5/54

[52] U.S. Cl. ..... 206/44 R; 206/45.21; 206/602; 229/115; 229/148; 229/164; 229/171

[58] Field of Search ..... 206/44 R, 45.2, 45.28, 206/45.21, 45.29, 427, 434, 602, 627, 192; 229/33

[56] References Cited

U.S. PATENT DOCUMENTS

| | | | |
|---|---|---|---|
| 1,803,028 | 4/1931 | Menten | 206/528 |
| 2,260,428 | 10/1941 | Barr et al. | 206/44 R |
| 2,426,865 | 9/1947 | Fink | 206/45.14 |
| 2,457,291 | 12/1948 | Wentzel | 206/45.29 |
| 2,505,399 | 4/1950 | Hilton | 206/45.14 |
| 2,523,986 | 9/1950 | Foster | 206/156 |
| 2,593,689 | 4/1952 | Mitchell | 206/422 |
| 2,684,178 | 7/1954 | Keeler | 206/192 |
| 3,156,358 | 11/1964 | Randrup | 206/153 |
| 3,157,275 | 11/1964 | Tolaas | 206/45.14 |
| 3,167,179 | 1/1965 | Goldstein | 206/44 R |
| 3,168,963 | 2/1965 | Wolowicz | 206/139 |
| 3,208,583 | 9/1965 | Kamps | 206/44 R |
| 3,227,266 | 1/1966 | Soma | 206/44 R |
| 3,347,356 | 10/1967 | Kosshar | 206/45.29 |
| 3,380,574 | 4/1968 | deKerland | 206/45.14 |
| 3,478,951 | 11/1969 | Graser | 206/434 |
| 3,604,614 | 9/1971 | Sternfeld | 206/434 |
| 3,642,125 | 2/1972 | Johnson | 206/47 R |
| 3,674,133 | 7/1972 | Locke | 206/44 R |
| 4,000,811 | 1/1977 | Hardison et al. | 206/44 R |
| 4,053,101 | 10/1977 | Hart, Jr. | 229/36 |
| 4,058,206 | 11/1977 | Morse et al. | 206/44 R |
| 4,116,330 | 9/1978 | Ellis | 206/44 R |
| 4,213,559 | 7/1980 | Meyer | 229/16 D |
| 4,256,223 | 3/1981 | Pawlowski | 206/192 |
| 4,328,922 | 5/1982 | Hirata | 229/27 |
| 4,396,115 | 2/1983 | Watson | 206/44 R |
| 4,421,229 | 12/1983 | Pan et al. | 206/602 |
| 4,448,303 | 5/1981 | Beckenfeld | 206/44 R |
| 4,467,923 | 8/1984 | Dornbusch et al. | 229/33 |

FOREIGN PATENT DOCUMENTS

| | | | |
|---|---|---|---|
| 829134 | 12/1969 | Canada | 229/33 |
| 382645 | 12/1964 | Switzerland | 206/602 |
| 1000243 | 8/1965 | United Kingdom | 206/45 |
| 1212854 | 11/1970 | United Kingdom . | |

*Primary Examiner*—William Price
*Assistant Examiner*—Brenda J. Ehrhardt
*Attorney, Agent, or Firm*—Ronald J. Snyder; John V. Gorman; Richard C. Witte

[57] ABSTRACT

A combination shipping and display container for packaged products is described as including a substantially open tray with a high back panel, a low front panel, and substantially open side panels connecting the front and back panels. The container includes a pair of integral divider flaps which extend between the back panel and the front panel and have a height which is substantially equal to that of the back panel. A top panel extends forwardly from the upper edge of the back panel to the front of the container and further includes a top panel extension which folds downwardly and includes means for establishing locking engagement with the container. The container is adapted to adequately protect a plurality of packaged products while providing substantial open display area in its front and side panels.

29 Claims, 12 Drawing Figures

TRAY-TYPE SHIPPING AND DISPLAY CONTAINER

CROSS-REFERENCE TO RELATED APPLICATION

This is a continuation-in-part of prior co-pending application entitled "Tray-Type Shipping and Display Container", Ser. No. 630,312, filed July 12, 1984, now abandoned, in the name of the present applicants.

TECHNICAL FIELD

This invention relates to a shipping and display container for packaged products, and, more particularly, to a substantially open tray-type container having integral separator panels and a top panel with a front flap portion which folds downwardly and includes means for establishing locking engagement with the container.

BACKGROUND ART

Containers which can be utilized for both shipping and display of various products are relatively abundant in the art. U.S. Pat. No. 3,157,275, which issued to W. M. Tolaas on Nov. 17, 1964, for example, discloses a display folder for bottles and jars which is formed from a single blank of material The Tolaas display folder includes a panel having apertures formed to accommodate the upper and lower portions of a bottle to be displayed. A similar display container is disclosed in Canadian Pat. No. 829,134, which issued to Douglas A. Morton on Dec. 9, 1969. This latter patent shows an individual product carton featuring retainer-type end panels which serve to contain the product therewithin.

A combination shipping container and display box is also disclosed by U.S. Pat. No. 4,053,101, which issued to John J. Hart, Jr. on Oct. 11, 1977. In this patent, partition sections may be placed within the container prior to its closure and the container can be converted to a display box by separating the cover portion of the container therefrom.

Other prior art has been aimed at providing a package for securely containing cylindrical objects therein. For example, U.S. Pat. No. 3,642,125, which issued to G. F. Johnson on Feb. 15, 1972, shows a shipping carton formed from a single carton blank and featuring an outer top panel having a bracing flap which is folded inwardly to engage the upper portions of a cylindrical object to be shipped.

Despite all the prior work done in this area, there remain problems in effectivley utilizing a single container for both shipping and display of packaged products. With prior art containers, one had to choose between adequate support and protection for the shipped product, and adequate display of such product within the unmodified container. The prior art did not provide a container featuring adequate product support, adequate display features, and dividability into two or more subcontainers (each featuring similar support and display characteristics), without additional inner packs or other modification of the container. Container assembly often could not easily be accomplished with automatic equipment, and use of the containers for display purposes often required additional handling and/or manual modification of the container. On the other hand, containers with adequate open display area often required additional shipping protection and/or packing within larger containers.

DISCLOSURE OF THE INVENTION

It is an object of this invention to obviate the above-described problems.

It is another object of the present invention to provide a container formed from a single blank of material and which, when erected, can be used either individually or in a multiple unit arrangement for both shipping and display of packaged products.

It is yet another object of the present invention to provide a shipping and display container which maximizes the area of hdisplay of product contained while providing adequate product support and container stackability.

It is an object of the present invention to provide a shipping and display container which maximizes the area of display of the product contained while providing adequate product support and stackability; and which is readily dividable into two or more subcontainers, each having similar adequate display, support and stackability characteristics.

It is also an object of the present invention to provide a shipping and display container which can be formed and packed on automatic equipment and which requires no additional modification for display purposes.

In accordance with one aspect of the present invention, there is provided a combination shipping and display container for packaged products which includes a substantially open tray having a high back panel, a low front panel and substantially open side panels connecting the front and back panels. The container also includes integral separator panels which extend between the back panel and the front panel, and which have a height substantially equal to that of the back panel. A top panel extends from the upper edge of the back panel forwardly to the front of the container, and includes a front flap portion attached to its front distal edge adapted to fold downwardly and having means for establishing locking engagement with the container.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Figure 1:
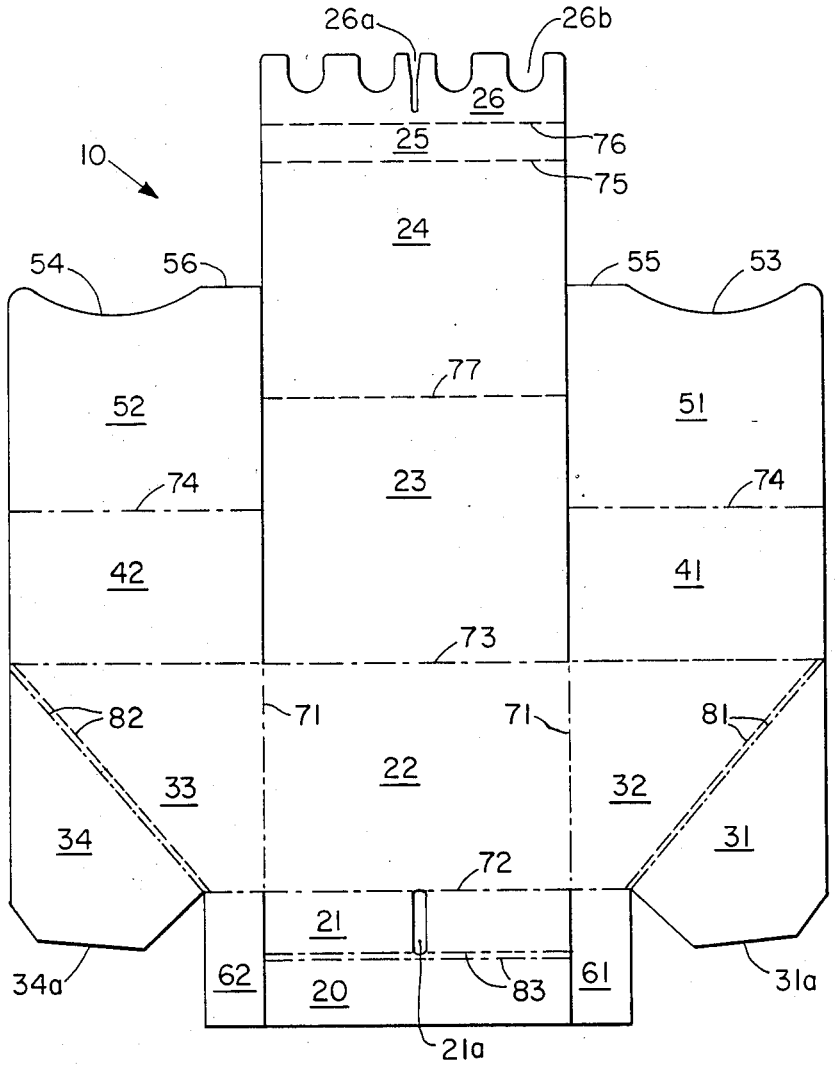
FIG. 1 is a plan view showing the inner surface of a container blank for erecting a preferred embodiment of the container of the present invention.
Figure 4:
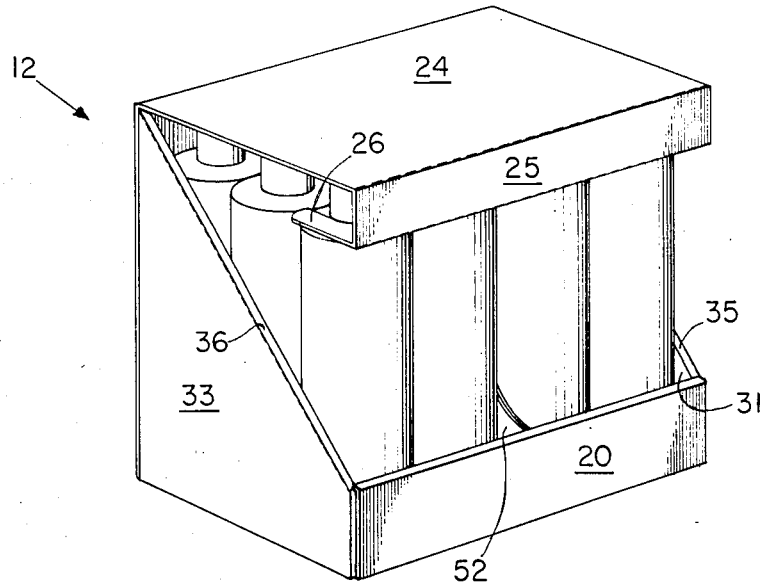
FIG. 4 is a perspective view of a completed container erected from the blank of FIG. 1 with product packed therewithin.

Referring now to the drawings in detail, wherein like numerals indicate the same elements throughout the views, a tray-type shipping and display container 12 of the present invention is shown in FIG. 4. The container 12 is erected from blank 10 of FIG. 1. Blank 10 can be formed of a single piece of corrugated cardboard, fiberboard, or the like, and is of conventional thickness. Blank 10 comprises a front panel including an outer front panel 20 and an inner front panel 21, a bottom panel 22, a rear panel 23 and a top panel 24 foldably connected together in serial relation along parallel transverse score lines 72, 73 and 77, respectively. The front panel is divided into its inner and outer portions by double score line 83. The parallel individual score lines making up double score line 83 are preferably spaced from one another at a distance of approximately twice the thickness of the container blank material to allow a comfortable fit of intermediate front flaps 61 and 62 between outer and inner front panels 20 and 21, as will be described below. Top panel extension 25 is hingedly connected along score line 75 to the distal edge of top panel 24, and re-entrant retainer flap 26 is hingedly connected along score line 76 to the top distal edge of extension 25. Re-entrant flap 26 is shown including a centrally located longitudinal retainer slot **26*a* and a plurality of cutouts 26*b*** spaced along its distal edge. These elements will be discussed in greater detail below.

Hingedly connected along parallel score lines 71 to the opposite lateral edges of bottom flap 22 are the right and left outer side panels, 32 and 33, respectively. A pair of right and left inner side panels, 31 and 34, are integrally connected to the distal edge of corresponding outer side panels 32 and 33 along double score lines 81 and 82, respectively. As will be seen, inner side panels 31 and 34 will be folded inwardly during the container erection procedure such that their bottom edges, **31*a* and 34*a*, create an interference or frictional fit with bottom panel 22, thereby retaining the inner side panels 31 and 34 in face to face relationship with corresponding outer panels 32 and 33. The parallel individual score lines of double score lines 81 and 82 should be spaced at a distance of approximately twice the thickness of the carton blank material, thereby providing a smooth surface (35 and 36) on the upper edges of the containers side walls. While it is not critical to have such smooth upper surfaces of the side walls of the container, as will be discussed with relation to FIGS. 5 and 6**, such smooth surfaces are preferred for overall container appearance and consumer appeal.

Hingedly connected along transverse score line 72 to the front edge of corresponding outer side panels 32 and 33 is a pair of right and left intermediate front flaps 61 and 62, respectively.

Figure 3:
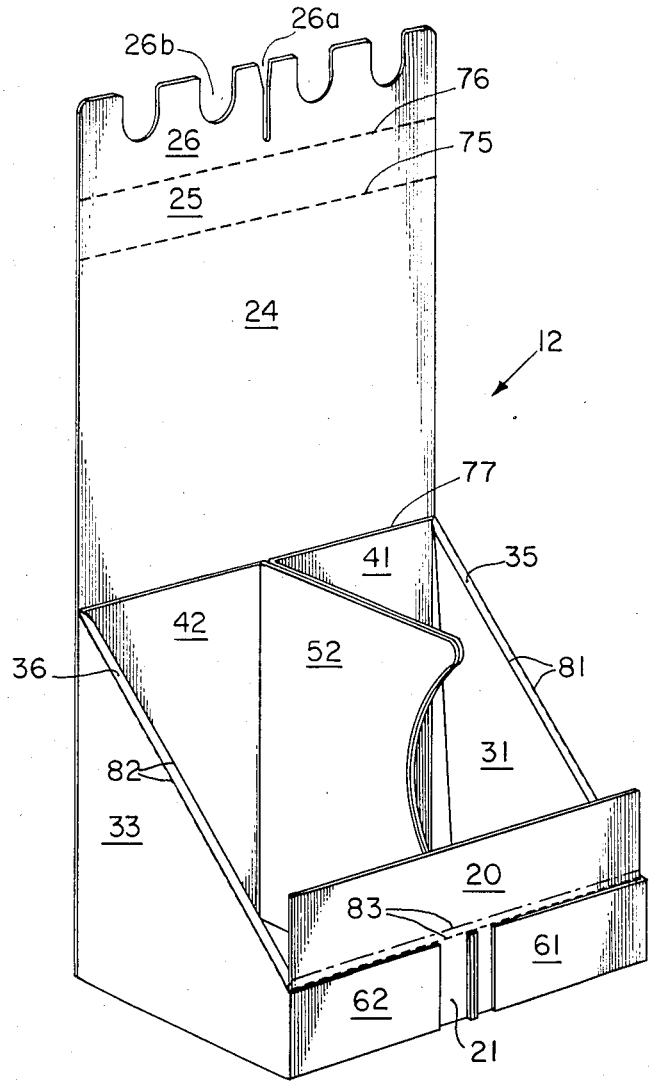
FIG. 3 is a perspective view of the blank of FIG. 1 with the outer side walls folded inwardly 90°, the outer rear wall folded upwardly 90° with its inner surfaces adhered to the outer surfaces of the inner rear panels, the front flaps folded upwardly 90°, and with the intermediate front flaps folded inwardly 90° and adhered to the outer surfaces of the inner front flap.

Integrally connected and hingedly attached along transverse score line 73 to the rear edges of corresponding outer side panels 32 and 33 is a pair of right and left inner rear panels 41 and 42, respectively. Each inner rear panel 41 and 42 also has a divider flap (51 and 52) integrally connected to its distal rear edge along score line 74. In a preferred embodiment, divider flaps 51 and 52 have a portion of their distal edges removed (as shown at 53 and 54) to facilitate product display and access within the completed container. It is also preferred that the lowermost edges (55 and 56, respectively) be formed as tab sections which, as will be shown, can be integrally locked into a slot (as shown at **21*a*) or slots (not shown) formed in front panel 21 for added container rigidity. Slot 21*a* extends longitudinally across substantially the entire height of inner front panel 21 and has a width of approximately two times the thickness of the carton blank material. In a preferred embodiment, it is contemplated that dividers 51 and 52 will be in face to face relationship, as shown in FIG. 3, in order to serve the dual function as a central partition wall and as a vertical support member for top panel 24. Divider panels 51 and 52** could be spaced apart to provide dual dividing walls and dual vertical support, however, such an arrangement might sacrifice effective display area and limit accessability to the contents of the container.

Figure 2:
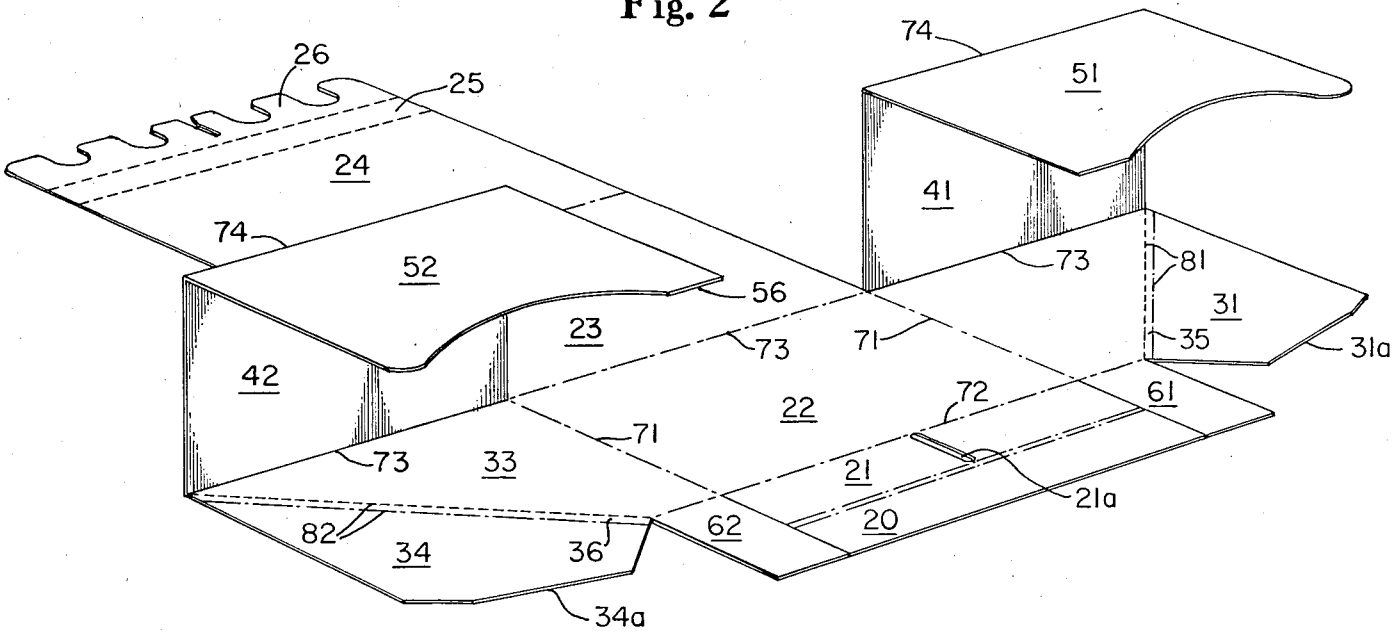
FIG. 2 is a perspective view of the blank of FIG. 1 with the divider panels folded 90° to a vertical position relative to the inner rear flaps, and the inner rear flaps folded 90° to a vertical position relative to the outer side wall panels.

Assembly of the container 12 from blank 10 involves a relatively straightforward series of folds. After blank 10 is initially cut and scored, divider flaps 51 and 52 are folded upwardly 90° along score line 74 and then inner rear flaps 41 and 42 are likewise folded upwardly 90° along score line 73, as shown in FIG. 2. The side walls (31 and 32, and 33 and 34, respectively) are then folded inwardly 90° about the parallel score lines 71, thereby bringing divider flaps 51 and 52 into face to face contact, as seen in FIG. 3. At the same time inner side walls 31 and 34 can be folded inwardly 180° such that their lower edges (**31*a* and 34*a*, respectively) act to frictionally hold the respective inner side panels against bottom panel 22 and in face to face relation with outer side panels 32 and 33, respectively. It is to be understood that the frictional action described could easily be substituted by adhesive or other attachment means, and is meant only as an example of how the inner and outer side walls could be held in face-to-face position. As seen best in FIG. 3, double score lines 81 and 82 provide a smooth upper surface (35 and 36, respectively) for the double side wall panels. As will be seen with respect to FIGS. 5 and 6**, such smooth side wall surfaces are not critical to the successful practice of the invention. Smooth surfaces are preferred, however, to provide an overall more finished appearance and quality to the container.

Next, adhesive can be applied to the inner surface of outer rear panel 23, and thereafter outer rear panel 23 is folded inwardly and upwardly 90° about score line 73 and adhered to the outer surfaces of the inner rear panels 41 and 42. At this point, the partially completed container can be front (gang) loaded or top loaded with packaged product.

Whether or not product is loaded at this point, the container is further erected as the front panel, comprising inner front panel 21 and outer front panel 20, is folded inwardly and upwardly 90° about score line 72 such that the locking tabs 55 and 56 of divider panels 51 and 52 extend into slot 21*a* for locking engagement therewith. The locking relationship of divider panels 51 and 52 with front panel 21 is not absolutely necessary, however, it is perferred in order to provide lateral support to the divider panels and to increase the overall rigidity of the container. Adhesive can now be applied to the inner surfaces of the intermediate front panels 61 and 62, and these panels are then folded inwardly 90° about score line 72 and adhered to the outer surfaces of inner front flap 21. The partially completed container is shown in FIG. 3. It is contemplated that the precise details of the application of adhesive to the various container elements may be varied to best suit the assembly equipment being utilized.

Adhesive can now be applied to either the outer surface of outer front panel 20 and/or the outer surfaces of the intermediate front flaps 61 and 62. Thereafter, outer front flap 20 is folded outwardly and downwardly 180° about double score line 83 and adhered to the outer surfaces of the intermediate front flaps 61 and 62. If product has not been previously loaded, product can be top loaded into the partially completed container 12 at this time. It should be noted that although outer front flap 20 is preferably included to provide a more substantial front container panel and a more finished appearance, it is within the scope of this invention to omit front flap 21 completely.

Once container 12 is loaded, the top closure is completed by folding top panel 24 inwardly 90° about score line 77, folding top panel extension 25 inwardly 90° about score line 75, and folding re-entrant retainer flap 26 inwardly approximately 90° about score line 76 such that retainer slot 26*a* lockingly engages divider flaps 51 and 52 within the container, and cutouts 26*b* supportingly nest around the upper portions of at least some of the packaged products contained within container 12. Score lines 75, 76 and 77 are shown as preforated score lines to insure accurate folding during erection procedures. Perforating score lines is commonly used where such accurate folding is required, however, the details of how the score lines are formed are not critical to the instant invention. The completed container 12 is illustrated in FIG. 4. Retainer slot 26*a* serves to lock top panel 24 into its closed position, while cutouts 26*b* augment the locking action and add greater stability to the product contained therewithin. It should be noted that the cutouts 26*b* are not critical to the successful practice of the current invention. It is only important that the retainer flap serve to lock top panel 24 in its closed position. While it is preferred that re-entrant flap 26 include cutouts in its distal edge having a shape substantially complementary to the upper portions of at least a portion of the packaged products contained, it is contemplated that the distal edge could function adequately without cutouts whereby re-entrant flap 26 would lockingly engage the divider flaps and simply butt up against the contained packaged products. Alternatively, it is contemplated that cutouts 26*b* could serve to lock top panel 24 in its closed position, exclusive of the slot 26*a*, by locking around the upper portions of the contained products. In such case, slot 26*a* could be omitted or enlarged sufficiently to no longer serve a locking function.

While locked in closed position, as described, top panel 24 serves to contain the packaged products and, together with the divider panels 51 and 52, provides substantial stacking strength to the container for shipping and display purposes. The completed container of the present invention (e.g. as illustrated in FIG. 4) provides support for contained products in substantially all directions of external loading, and can be handled in a manner similar to a "building block" to prepare displays and/or shipping loads due to its substantially uniform rectangular surfaces and its strong squared configuration. Such attributes make the subject container invaluably versatile in the industry. The completed container may also be overwrapped with shrink film, stretch wrap or other similar coverings for added strength and cleanliness during shipping and handling. Individual containers can thereafter be shipped individually or stacked and shipped on pallets, such as pre-built displays. Further, an entire stack of containers, or a pre-built display, can be conveniently unitarily wrapped so that only removal of such wrap need be undertaken at the retail store.

Following shipping and handling, the retailer may simply remove any overwrapping and display the product in the container as shown in FIG. 4. Alternative display procedures can include unlocking re-entrant flap 26 from its interlocked arrangement, folding top panel 24 back 270° and tucking top panel extension 25 and re-entrant flap 26 underneath the container 12, thereby providing a substantially open tray-type display. A similar open tray-type display can be accomplished by heavily perforating score line 77 of blank 10 so that the top portion of the container can be easily removed for display purposes. Top panel 24 can also be folded back 180° for interlocking support on multi-tiered display units. It can thus be seen that there are many ways to utilize the container of the present invention for convenient display with minimum handling requirements. The uses discussed herein are meant to serve only as examples and not in any way to limit the teachings of the present invention.

It should be understood that while the actual dimensions of the various elements of containers made in accordance with the present invention may be widely varied to accommodate particular packaging requirements, the relative dimensions of the front and side panels are to be such as to provide substantially open front and side walls for display purposes. In this regard, some situations may require larger front and side panels to ensure adequate support for shipping and handling; however, to take full advantage of the present invention the front and side walls should remain substantially open.

Figure 5:
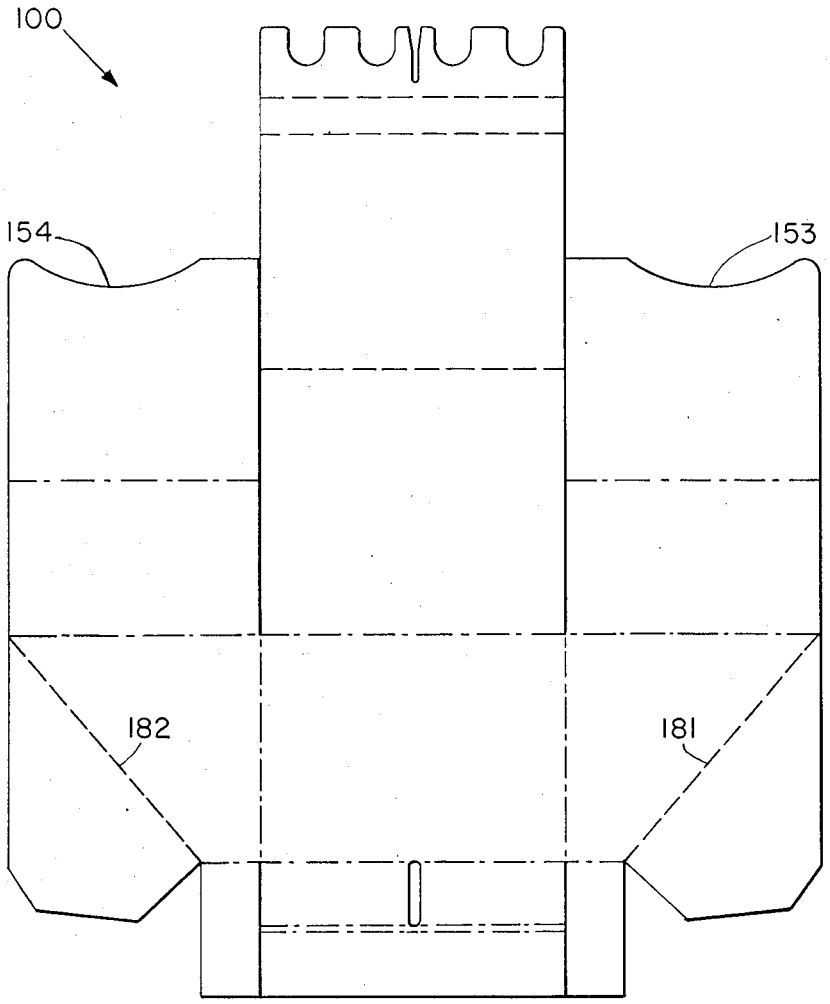
FIG. 5 is a plan view of a second embodiment of a container blank illustrative of the present invention.

As discussed above, it is not critical that the side walls of container 12 have the smooth upper surfaces 35 and 36, as shown in FIG. 4. FIG. 5 illustrates a container blank of an alternate embodiment of the present invention wherein single perforated score lines 181 and 182 replace the double score lines 81 and 82, respectively, as shown and described above with respect to FIGS. 1 through 4. The procedure for erecting the blank 100 of FIG. 5 is essentially exactly the same as that described above with regard to blank 10. The container formed from blank 100 would look substantially identical to the container 12 of FIG. 4, with the exception that the flat surfaces 35 and 36 would appear as a single perforated fold line 181 between the inner and outer side panels.

Figure 6:
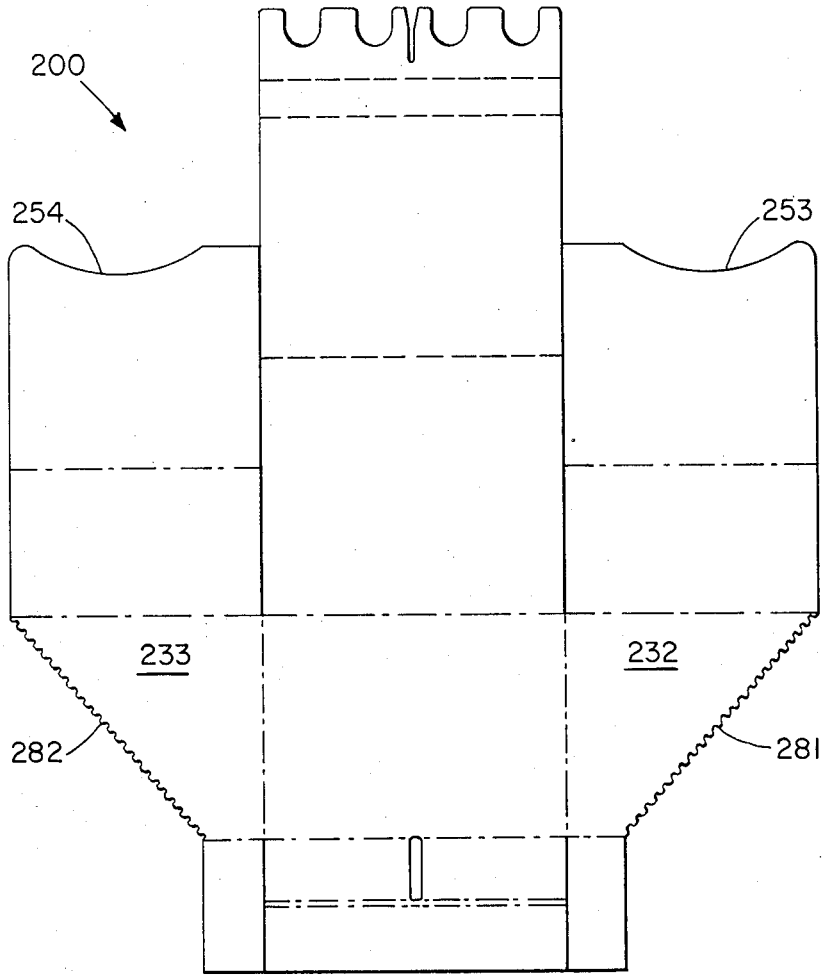
FIG. 6 is a plan view of a third embodiment of a container blank illustrative of the present invention.

FIG. 6 illustrates the carton blank of another alternate embodiment of the present invention featuring single side wall panels 232 and 233, respectively. Again blank 200 is erected in a substantially identical manner to the procedures described above regarding blank 10, however, the inner side wall folding step will be omitted for obvious reasons. The upper edges, 281 and 282 of side wall panels 232 and 233, respectively, are shown in FIG. 6 as including a plurality of serrations. Such serrations are shown only as an example of the unlimited ways in which the side wall edges can be formed in any desirable configuration. For example, edges 281 and 282 could be formed as a smooth cut (e.g., see edges 381 and 382 of FIG. 7) and/or could be formed with a non-linear shape (not shown) to provide additional open display area and access to the contents of the container.

As with container 12, containers erected from any of the blanks shown herein can also be overwrapped for shipping purposes, and can be shipped as an individual unit or conveniently stacked for multi-unit shipment. As discussed earlier with respect to the front edges 53 and 54 of divider panels 51 and 52, respectively, the corresponding distal (front) edges of the divider panels in the other blanks shown blanks (i.e., 153 and 154, 253 and 254, and 353 and 354, respectively) can be shaped to provide as much or as little access to contained product as desired, thereby providing convenient display and support for the top closure of the container. It can be seen, however, that increasing the amount of material cut from the divider panels may adversely affect the amount of vertical support provided by such divider panels during shipping and display.

Figure 7:
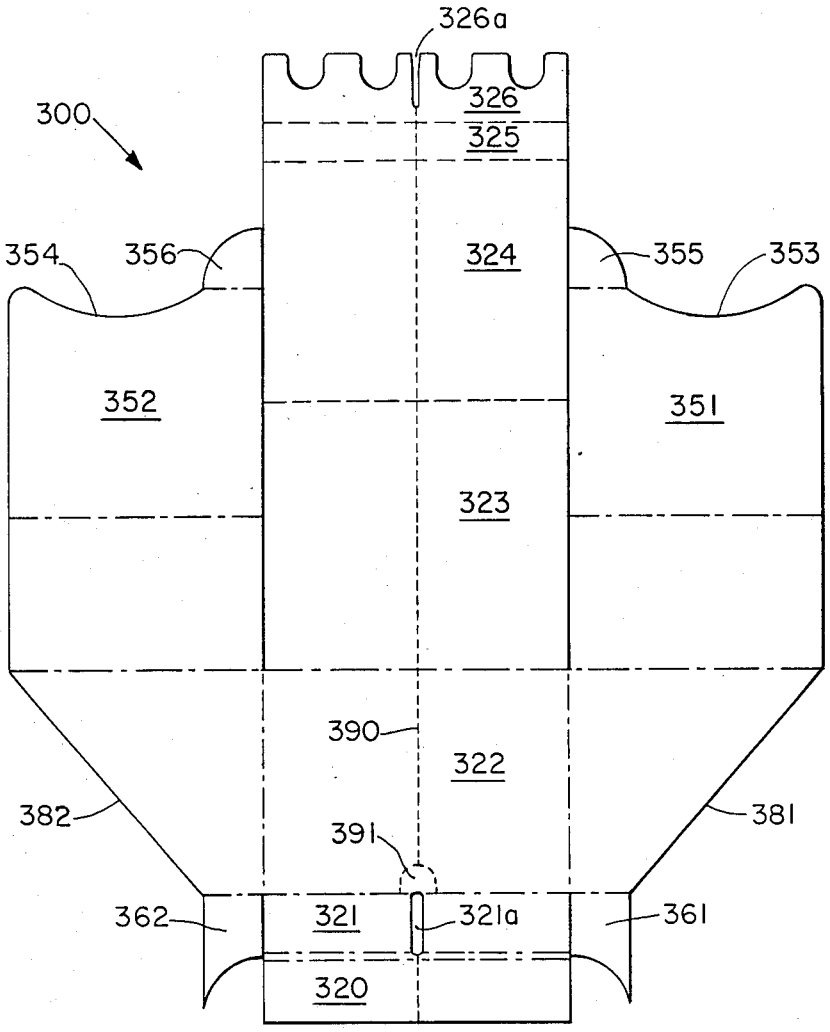
FIG. 7 is a plan view of a fourth embodiment of a container blank illustrative of the present invention.
Figure 8:
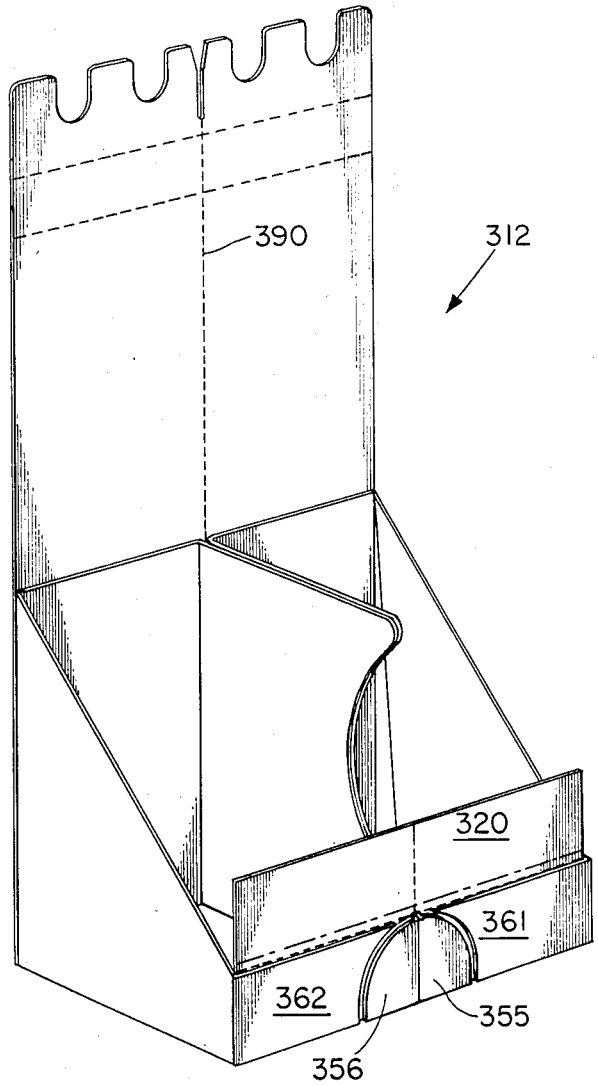
FIG. 8 is a perspective view of the blank of FIG. 7 corresponding to the similar partially erected container shown in FIG. 3.
Figure 9:
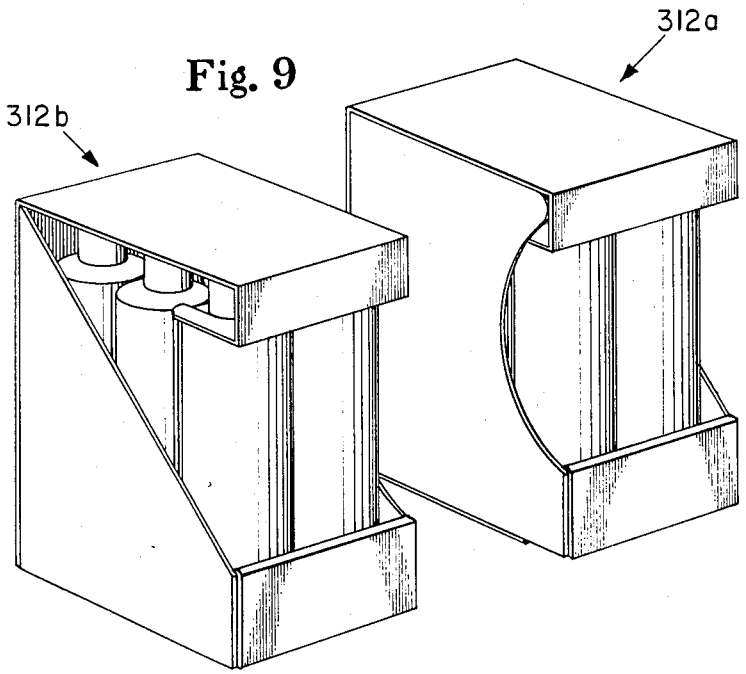
FIG. 9 is a perspective view of a completed container erected from the blank of FIG. 7, with said completed container divided into two subcontainers along a central line of severance.

FIGS. 7 through 9 illustrate another example of a container made in accordance with the present invention having an additional feature of being dividable into subcontainers in use. Particularly, FIG. 7 shows the inner surface of container blank 300, which is quite similar in appearance to blank 200 of FIG. 6. However, divider flap securing tabs 355 and 356 are formed on the lower distal edge of divider flaps 351 and 352, respectively. Also side wall edges 381 and 382 have been cut smooth for illustration purposes. Securing tabs 355 and 356 will extend into the centrally located slot 321*a* as inner front flap 321 is folded upwardly during the erection procedure. The erection procedure is substantially identical to that described above with respect to blank 200, except that after securing tabs 355 and 356 are extended through slot 321*a*, they are folded 90° outwardly and their inner surfaces are adhesively joined to the outer surface of inner front flap 321.

FIG. 8 shows the partially assembled view of container 312 with securing tabs 355 and 356 adhesively secured to inner front flap 321, as described. As also shown in FIG. 8, intermediate front flaps 361 and 362 can be formed with their distal edges having a shape complementary to that of the distal edges of securing tabs 355 and 356, although this is not essential. Such complementary shape might be preferred, however, especially if outer front flap 320 were to be omitted.

The distal edges of securing tabs 355 and 356 are preferably formed with a curved conformation, as shown, to facilitate their extension through slot 321*a* during automatic container erection. Blank 300 is also provided with a line of severance 390 extending longitudinally aross outer front panel 320, bottom panel 322, outer rear panel 323, top panel 324, top panel extension 325, and retainer panel 326 in alignment with the centrally located slots 321*a* and 326*a*. Such line of severance 390 can be performations, lines of weakenss, slits, a removable tear tape, a combination of these elements, or merely printed indicia to facilitate cutting; and is designed to facilitate separation of portions of the container lying on opposite sides of the line into subcontainers. As an example of a combination of these elements as a line of severance, a blank (not shown) could be provided with line of severance 390 have slits formed across a substantial portion of bottom panel 322 and outer rear panel 323, perforations formed across outer front panel 20, and printed indicia across top panel 324, extension panel 325 and retainer panel 326. The resulting container could be easily divided by simply cutting along the top, top extension, and retainer panels, and then popping the container apart along the perforatons. Additionally, a tear tab 391 is shown in FIG. 7 as a means to further facilitate the separation of the two subcontainers. Tear tab 391 could be a perforated finger tab, or an open finger hole, or the like, and might be desirable to provide a convenient location to begin removal of a tear tape, to facilitate a cutting procedure, or to facilitate separation along lines of weakness. It is preferred that slots 321*a* and 326*a* be centrally located in order to provide two substantially equally sized subcontainers, but this is not essential.

FIG. 9 shows container 312 after it has been divided into two subcontainers (312*a* and 312*b*, respectively) along the line of severance 390. As shown, each subcontainer is a complete container in itself which can be further shipped and/or displayed (without a need for additional packing material or container modification) as described above with regard to the other embodiments shown and discussed.

Figure 10:
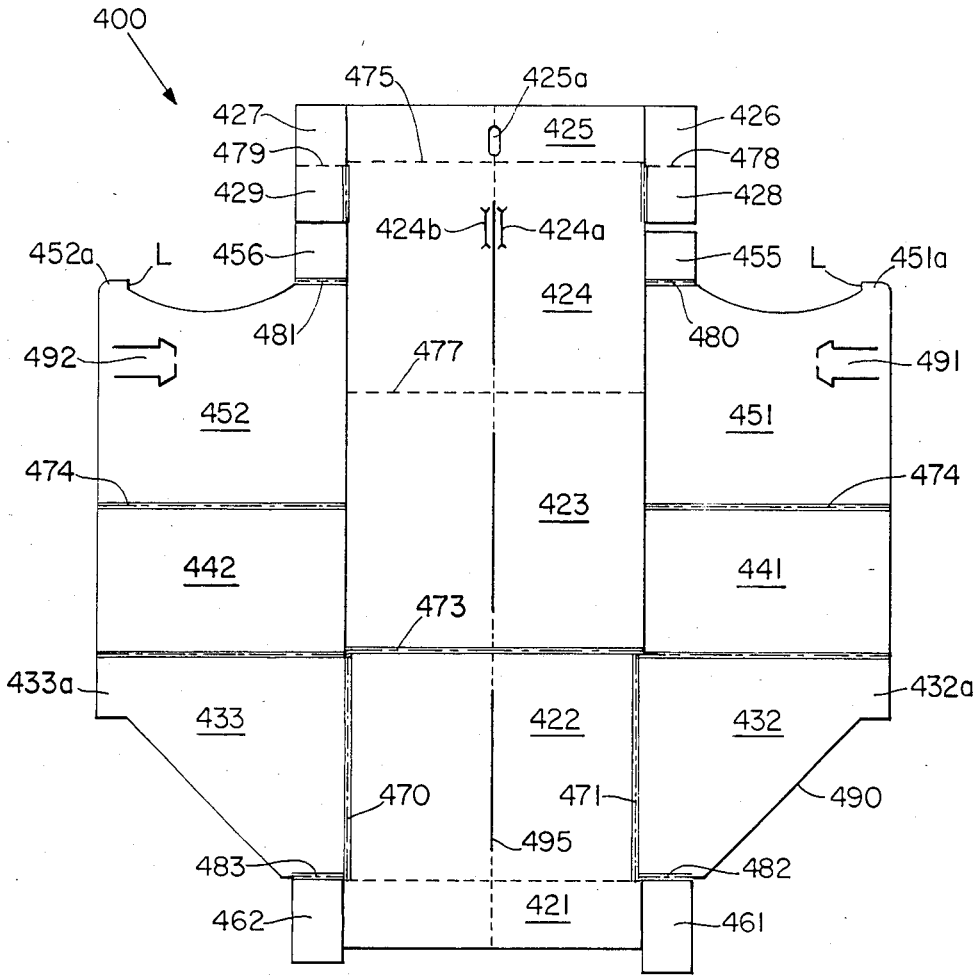
FIG. 10 is a plan view of a fifth embodiment of a container blank illustrative of the present invention.

FIG. 10 illustrates the carton blank of yet another alternate embodiment of the present invention featuring modified front panel and side panel structures, and including a particularly preferred method of interlocking the divider panels and the top flap extension. In particular, FIG. 10 discloses carton balnk 400 which is to be erected in a substantially similar manner to the procedures described above regarding blank 200. Erection of the front panels of carton balnk 400 differs slightly in that inner front flaps 461 and 462 are to be folded inwardly about score lines 482 and 483, respectively, and adhered to the inner surface of front flap 421 when sidewalls 432 and 433 and front flap 421 are folded upwardly. Additionally, divider flap securing tabs 455 and 456, respectively, are to be folded inwardly so that they extend outwardly in the assembled position and can be adhered to the inner surface of front flap 421. For these reasons, it can be seen that the combined length of inner front flaps 461 and 462 and divider flap securing tabs 455 and 456 is preferably equal to or less than the width of front flap 421. In FIG. 10, inner front flap 461 is illustrated as being slightly longer than inner front flap 462, while divider flap securing tab 455 is inversely shorter than securing tab 456 in order to facilitate the necessary folding and erection procedures on automatic manufacturing equipment. Such designed dimensional inconsistencies are commonly employed in the industry for this purpose and are not considered critical to the unique structure and utility of the subject container.

Figure 11:
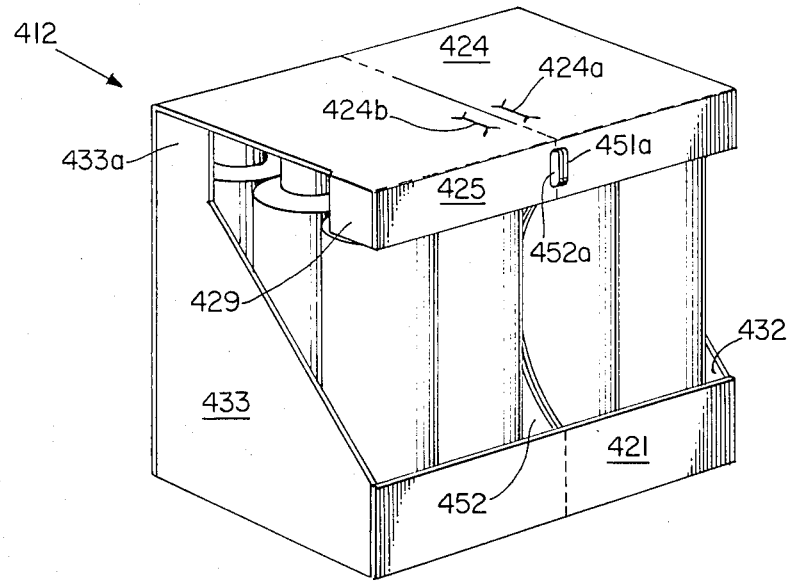
FIG. 11 is a prospective view of a completed container erected from the blank of FIG. 10 with product packed therewithin.

Similarly, inner top panel front flaps 426 and 427 are folded upwardly about score lines 478 and 479, respectively, and then inwardly (as sidewall extensions 428 and 429 are folded upwardly) such that their outer surface can be adhered to the inner surface of the upwardly folded top panel front flap 425. Top panel 424 can then be folded forwardly about score line 477 to effectively close the top of the erected container 412, and can be effectively "locked" in place by the locking engagement of locking edges 451*a* and 452*a* of the divider flaps with top panel front flap slot 425*a* (as shown in FIG. 11). As best seen in FIG. 10, it is preferred that locking edges 451*a* and 452*a* include an appropriate locking lip or horizontal edge L to positively interlock with slot 425*a*. It should be understood that in applications where divider flaps 451 and 452 are spaced apart to provide dual dividing walls, a pair of top panel front flap slots 425*a* would be required. As mentioned above, the precise manner of acommplishing the locking engagement of top panel front flap 425 with divider flaps 451 and 452 is not critical and can be accomplished in a variety of ways. Positive locking is preferred, however, for more reliable protection during shipping and handling.

Figure 12:
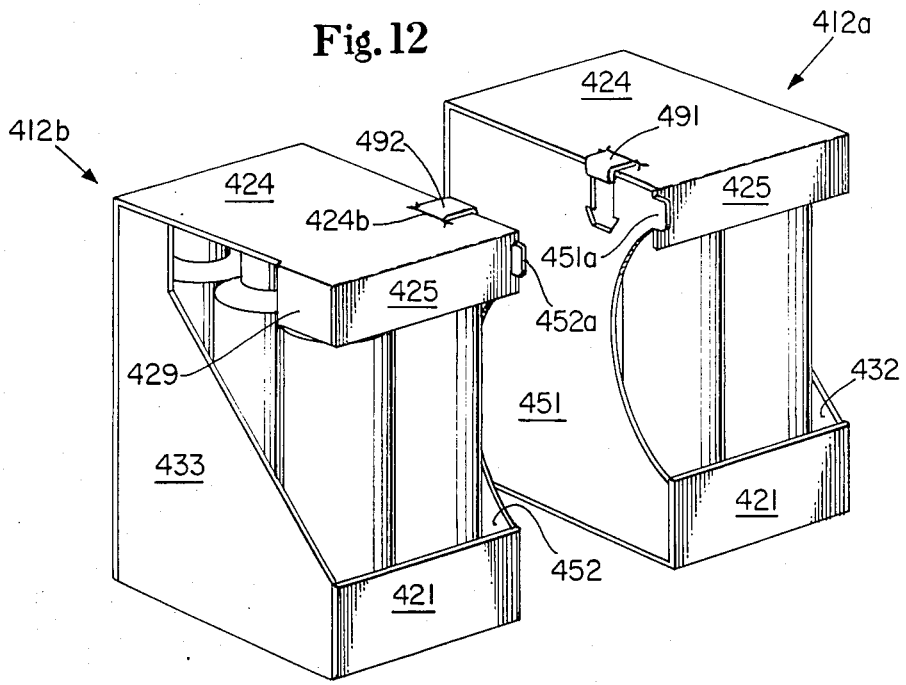
FIG. 12 is a prospective view of a completed container erected from the blank of FIG. 10, with said completed container divided into two subcontainers along a central line of severance.

As shown in FIGS. 10 through 12, it is also preferred that sidewalls 432 and 433 include a portion (432*a* and 433*a*, respectively) near their proximal rear edge having a height substantially equal to the height of rear wall 423. While not critical to the container structure, side wall top flap supports 432*a* and 433*a* add significant columnar support to top flap 424 and augment the overall rigidity to container 412. Simiarly, it is preferred that top flap sidewall extensions 428 and 429 be included in container blank 400 to add strength and rigidity to top panel 424 and top panel front flap 425. Sidewall extensions 428 and 429 are shown as being hingedly attached along the distal lateral edges of top flap 424. These sidewall extensions can be rigidly fixed in a manner shown in FIGS. 11 and 12 as being hingedly connected to both top panel 424 and one of inner top panel front flaps 426 and 427, respectively, which are in turn adhered to the inner surfaces of top panel front flap 425 as described above. Sidewall extensions 428 and 429 additionally add lateral constraint to product packaged within container 412.

Blank 400 may also be provided with a line of severance 495 extending longitudinally across the top panel front flap 425, top flap 424, rear flap 423, bottom panel 422, and front flap 421. It is preferred that such line of severance be in alignment with the centrally located locking slot 425*a*. As described relative to container blank 300 above, such line of severance 495 can be perforations, lines of weakness, slits, a removable tear tape, a combination of these elements, or merely printed indicia to facilitate cutting; and is similarly designed to facilitate separation of portions of container 412 lying on opposite sides of line 495 into subcontainers. It is prferred that at least a portion of line of severance 495 be spaced slits or perforations to provide for convenient division of container 412. Blank 400 and the erected container 412 are shown as including line of severance 495, which comprises a combination of perforations and slits as an example of a preferred manner of providing convenient division of container 412.

FIG. 12 shows container 412 after it has been divided into two subcontainers (412*a* and 412*b*, respectively) along the line of severance 495. As described above with regard to container 312, each subcontainer 412*a* and 412*b* is a complete container in itself which can be further shipped and/or displayed as described above. However, because division of container 412 into subcontainers 412*a* and 412*b* substantially defeats the locking interaction between top panel front flaps slot 425*a* and locking edges 451*a* and 452*a* of the divider flaps, it is preferred that fold-out locking tabs 491 and 492 be formed in divider flaps 451 and 452, respectively, in order to provide alternate means of locking top panel 424 in closed condition. As illustrated in FIG. 12, a preferred means of providing such alternate locking means for top panel 424 includes fold-out locking tabs 491 and 492 which are folded outwardly and upwardly around the edge of top panel 424 and tucked into tab locking slit 424*a* and 424*b*, respectively, formed in top panel 424. Tab locking slit 424*a* is illustrated as including a single slit having two or more short, radially divergent slits (or crow-footed slits) at either end.

Locking tabs 491 and 492 are illustrated as including a base portion and an enlarged locking end. It is preferred that tab locking slit 424*a* have a length substantially equal to the width of the base of the locking tabs, and the crow-footed ends of tab locking slits 424*a* and 424*b* thereby allow the insertion of the enlarged end of the locking tabs therethrough. The distal end of the enlarged locking end of the tabs is tapered to facilitate insertion through the tab locking slits, and includes substantially horizontal undercut portions to effectively lock the tabs within the tab locking slits once inserted therethrough. In use, after container 412 is divided into two subcontainers, and locking tabs 491 and 492 are folded outwardly and over top panel 424 for locking insertion with tab locking slits 424*a* and 424*b*, respectively, the subcontainers 412*a* and 412*b* are ready for further shipping, handling and display. The convenient re-locking features of both the complete container 412 and the individual subcontainers 412*a* and 412*b* permit opening of the containers for price marking, product exchange, and the like during shipping; and subsequent convenient reclosure for further shipping and handling in either full or partial case lots. Furthermore, container 412 combines these advantages with efficient blank material usage and the ability to be manufactured on automatic machinery commonly available in the industry.

Having shown and described the preferred embodiment of the present invention, further adaptions of the container can be accomplished by appropriate modifications to the blank of the container by one of ordinary skill in the art without departing from the scope of the present invention. Accordingly, the scope of the present invention should be considered in terms of the following claims and is understood not to be limited to the details of structure and operation shown and described in the specification and drawings.

We claim:

1. A combination shipping and display container for packaged products, said container comprising a substantially open tray having a high back panel, a low front panel providing a substantially open front wall, substantially open side panels connecting said low front panel and said high back panel, a pair of integral divider flaps extending between said back panel and said front panel and having a height substantially equal to that of said back panel, and a top panel extending forwardly from the upper edge of said back panel to the front of said container, said top panel having a top panel extension which folds downwardly to form an upper front flap portion which does not substantially close said substantially open front wall of said container and which includes means for establishing locking engagement with said divider flaps adjacent the upper front portion of such divider flaps.

2. The container of claim 1 wherein said means for establishing locking engagement of said front portion of said top flap with said container comprises at least one slot formed in said front flap portion for locking engagement with corresponding locking edges formed on the upper front portion of each of said divider flaps.

3. The container of claim 1, wherein said top panel further comprises a re-entrant portion attached to its distal edge which folds downwardly and inwardly into said container and includes means for establishing locking engagment with said divider flaps of said container.

4. A combination shipping and display container for packaged products, said container comprising a substantially open tray having a high back panel, a low front panel providing a substantially open front wall, substantially open side panels connecting said low front panel and said high back panel, a pair of integral divider flaps extending between said back panel and said front panel and having a height substantially equal to that of said back panel, and a top panel extending forwardly from the upper edge of said back panel to the front of said container, said top panel having a top panel extension which folds downwardly to form a upper front flap portion which does not substantially close said substantially open front wall of said container, and having a re-entrant portion attached to its distal edge which folds downwardly and inwardly into said container and includes means for establishing locking engagement with said divider flaps adjacent the upper front portion of such divider flaps.

5. The container of claim 4, wherein said re-entrant portion further comprises one or more cutouts formed in its distal edge, said cutouts having a shape substantially complementary to the upper portions of at least one of said packaged products to be contained therein.

6. The container of claims 4 or 5, wherein said container is formed from a unitary blank of material; said blank further comprising a pair of left and right inner rear wall panels, and a pair of left and right divider flaps hingedly affixed to corresponding inner rear wall panels.

7. The container of claim 6, wherein said means for establishing locking engagement of said re-entrant portion comprises at least one slot formed in said re-entrant and extending inwardly from its distal edge for frictional locking engagement with said divider flaps within said container.

8. The container of claim 5, wherein said cutouts serve as said means for establishing locking engagement of said re-entrant portion, said cutouts lockingly engaging the upper portions of at least one of said packaged products, thereby locking said reentrant within said container.

9. A combination shipping and display container adapted to adequately protect a plurality of packaged products while providing substantial open display area in its front and side panels, said container being formed from a unitary blank comprising:

(a) front, bottom, outer rear, and top panels foldably connected together in serial relation;

(b) a pair of right and left outer side panels integrally connected to respective opposite sides of said bottom panel along a pair of first score lines;

(c) a pair of right and left inner side panels integrally connected to the distal edge of the corresponding outer side panel along first and second sets of double score lines, respectively;

(d) a pair of right and left intermediate front flaps, each being integrally connected along a second score line to the front edge of the corresponding outer side panel;

(e) a pair of right and left inner rear panels, each being integrally connected along a third score line to the rear edge of the corresponding outer side panel, and each having a divider flap integrally connected along a fourth score line to its distal rear edge;

(f) front panel being divided into inner and outer panel sections by a third set of double score lines, with said inner front panel section having at least one slot formed therein for locking engagement with the upper front portion of said divider flaps;

(g) said inner and outer front and side panels having dimensions which provide said container with substantially open front and side walls for display purposes; and (h) said top panel having a top panel extension integrally connected to its distal edge along a fifth score line, said top panel extension further having a re-entrant retainer flap portion integrally connected to its distal edge along a sixth score line; said top panel extension folding downwardly to form an upper front flap portion which does not substantially close said substantially open front wall, said retainer flap having a least one slot formed therein for locking engagement with said divider flaps within said container, and having a plurality of cutouts in its distal edge adapted to substantially conform to the upper portions of at least some of said packaged products packed within said container for support thereof.

10. The container of claims 1, 4 or 9, wherein said divider flaps are in face to face relation thereby forming a double walled partition therein.

11. The container of claims 1, 4 or 9, wherein said divider flaps are laterally spaced from one another thereby dividing said container into three substantially open compartments.

12. A combination shipping and display container adapted to adequately protect a plurality of packaged products while providing substantial open display area in its front and side panels, said container being formed from a unitary blank comprising:

(a) front, bottom, outer rear, and top panels foldably connected together in serial relation;

(b) a pair of right and left outer side panels integrally connected to respective opposite sides of said bottom panel along a pair of first score lines;

(c) a pair of right and left inner side panels integrally connected to the distal edge of the corresponding outer side panel along first and second perforated score lines, respectively;

(d) a pair of right and left intermediate front flaps, each being integrally connected along a second score line to the front edge of the corresponding outer side panel;

(e) a pair of right and left inner rear panels, each being integrally connected along a third score line to the rear edge of the corresponding outer side panel, and each having a divider flap integrally connected along a fourth score line to its distal rear edge;

(f) said front panel being divided into inner and outer panel sections by a set of double score lines, with said inner front panel section having at least one slot formed therein for locking engagement with the upper front portion of said divider flaps;

(g) said inner and outer front and side panels having dimensions which provide said container with substantially open front and side walls for display purposes; and (h) said top panel having a top panel extension integrally connected to its distal edge along a fifth score line, said top panel extension folding downwardly to form an upper front flap portion which does not substantially close said substantially open front wall and having a re-entrant retainer flap portion integrally connected to its distal edge along a sixth score line; said retainer flap having a least one slot formed therein for locking engagement with said divider flaps within said container, and having a plurality of cutouts in its distal edge adapted to substantially conform to the upper portions of at least some of said packaged products packed within said container for support thereof.

13. A combination shipping and display container adapted to adequately protect a plurality of packaged products while providing substantial open display area in its front and side panels, said container being formed from a unitary blank comprising:

(a) front, bottom, outer rear, and top panels foldably connected together in serial relation;

(b) a pair of right and left side panels integrally connected to respective opposite sides of said bottom panel along a pair of first score lines;

(c) a pair of right and left intermediate front flaps, each being integrally connected along a second score line to the front edge of the corresponding side panel;

(d) a pair of right and left inner rear panels, each being integrally connected along a third score line to the rear edge of the corresponding side panel, and each having a divider flap integrally connected along a fourth score line to its distal rear edge;

(e) said front panel being divided into inner and outer panel sections by a set of double score lines, with said inner front panel section having at least one slot formed therein for locking engagement with said divider flaps;

(f) said inner and outer front panels and said side panels having dimensions which provide said container with substantialy open front and side walls for display purposes; and (g) said top panel having a top panel extension integrally connected to its distal edge along a fifth score line, said top panel extension folding downwardly to form an upper front flap portion which does not substantially close said substantially open front wall and having a re-entrant retainer flap portion integrally connected to its distal edge along a sixth score line; said retainer flap having at least one slot formed therein for locking engagement with the upper front portion of said divider flaps within said container, and having a plurality of cutouts in its distal edge adapted to substantially conform to the upper portions of at least some of said packaged products packed within said container for support thereof.

14. The shipping and display container of claims 1, 4, 9, 12 or 13, further comprising means for dividing said container into two subcontainers.

15. A combination shipping and display container adapted to adequately protect a plurality of packaged products while providing substantial open display area in its front and side panels, said container being further dividable into two subcontainers in use and formed form a unitary blank having an outer surface and an inner surface and comprising:

(a) front, bottom, outer rear, and top panels foldably connected together in serial relation;

(b) a pair of right and left side panels integrally connected to respective opposite sides of said bottom panel along a pair of first score lines;

(c) a pair of right and left intermediate front flaps, each being integrally connected along a second score line to the front edge of the corresponding side panel;

(d) a pair of right and left inner rear panels, each being integrally connected along a third score line to the rear edge of the corresponding side panel, and each having a divider flap integrally connected along a fourth score line to its distal rear edge, said divider flaps each having a securing tab located on its lower distal edge;

(e) said front panel being divided into inner and outer panel sections by a set of double score lines, with said inner front panel section having a slot formed therein through which said securing tabs of said divider flaps extend, said securing tabs being folded outwardly and the inner surface portion thereof adhesively united with the outer surface portion of said inner front panel section;

(f) said inner and outer front panels and said side panels having dimensions which provide said container with substantially open front and side walls for display purposes;

(g) said top panel having a top panel extension integrally connected to its distal edge along a fifth score line, said top panel extension folding downwardly to form an upper front flap portion which does not substantially close said substantially open front wall and having a re-entrant retainer flap portion integrally connected to its distal edge along a sixth score line; said retainer flap having a slot formed therein for locking engagement with the upper front portion of said divider flaps within said container, and having a plurality of cutouts in its distal edge adapted to substantialy conform to the upper portions of at least some of said packaged products packed within said container for support thereof; and (h) a line of severance in alignment with said slot in said inner front panel section and said slot in said retainer flap and traversing said outer front, bottom, rear and top panels, as well as said top panel extension and re-entrant retainer flap, said line of severance being adapted to facilitate separation of portions of the container lying on opposite sides of said line.

16. The shipping and display container of claim 15, wherein said line of severance further comprises a perforated line of weakness formed in said unitary blank.

17. The shipping and display container of claim 15, wherein said line of severance is a perforated tear tape formed in said unitary blank.

18. The shipping and display container of claim 17, wherein said line of severance includes a tear tab section to further facilitate removal of said perforated tear tape.

19. The shipping and display container of claim 15, wherein said line severance includes slits traversing a substantial portion of said bottom and rear panels, a perforated line of weakness traversing said outer front panel, and printed lines of indicia traversing said top, top panel extension, and re-entrant retainer flap panels.

20. A combination shipping and display container adapted to adequately protect a plurality of packaged products while providing substantial open display are in its front and side panels, said container being formed from a unitary blank comprising:

(a) front, bottom, outer rear, and top panels foldably connected together in serial relation;

(b) a pair of right and left side panels integrally connected to respective opposite sides of said bottom panel along a pair of first score lines;

(c) a pair of right and left inner front flaps, each being integrally connected along a second score line to the front edge of the corresponding side panel:

(d) a pair of right and left inner rear panels, each being integrally connected along a third score line to the rear edge of the corresponding side panel, and each having a divider flap integrally connected along a fourth score line to its distal rear edge;

(e) said front and side panels having dimensions which provide said container with substantially open front and side walls for display purposes; and (f) said top panel having a top panel extension integrally connected to its distal edge along a fifth score line, said top panel extension folding downwardly to form an upper front flap portion which does not substantially close said substantially open front wall and having top flap locking means formed therein for locking engagement with corresponding locking means on the upper front portion of said divider flaps.

21. The container of claim 20, wherein said top flap locking means further comprises at least one slot formed in said top panel extension for locking engagement with corresponding locking means on said divider flaps.

22. The container of claim 21, wherein said top panel further comprises a pair of right and left top flap sidewall extensions integrally connected along score lines at the lateral edges thereof adjacent said front flap portion.

23. The container of claim 22, wherein at least the rear portion of said right and left side panels have dimensions substantially equal to the height of said outer rear panel and thereby providing added support to said top panel when said container is in fully erected and closed condition.

24. The container of claim 20, wherein said divider flaps are in face to face relation thereby forming a double walled partition therein.

25. The container of claim 20, wherein said divider flaps are laterally spaced from one another thereby dividing said container into three substantially open compartments.

26. A combination shipping and display container adapted to adequately protect a plurality of packaged products while providing substantial open display are in its front and side panels, said container being further dividable into two subcontainers in use and formed from a unitary blank having an outer surface and an inner surface and comprising:

(a) front, bottom, outer rear, and top panels foldably connected together in serial relation;

(b) a pair of right and left side panels integrally connected to respective opposite sides of said bottom panel along a pair of first score lines;

(c) a pair of right and left inner front flaps, each being integrally connected along a second score line to the front edge of the corresponding side panel;

(d) a pair of right and left inner rear panels, each being integrally connected along a third score line to the rear edge of the corresponding side panel, and each having a divider flap integrally connected along a fourth score line to its distal rear edge, said divider flaps each having a securing tab located on its lower distal edge;

(e) said front panel and said side panels having dimensions which provide said container with substantially open front and side walls for display purposes;

(f) said top panel having a top panel extension integrally connected to its distal edge along a fifth score line, said top panel extension folding downwardly to form an upper front flap portion which does not substantially close said substantially open front wall and having a centrally located slot formed therein for locking engagement with corresponding locking emans on the upper front portion of said divider flaps; and (g) a line of severance in alignment with said slot in said top panel extension and traversing said top panel extension, as well as the front, bottom, rear and top panels, said line of severance being adapted to facilitate separation of portions of the container lying on opposite sides of said line.

27. The shipping and display container of claim 26, wherein at least a portion of said line of severance further comprises a perforated line of weakness formed in said unitary blank.

28. The shipping and display container of claims 26 or 27, wherein said divider flaps each further comprise an integral locking tab which can be folded upwardly following division of said container into two subcontainers for locking engagement with a corresponding tab locking slot formed in said top panel to retain the respective top panels of the two resulting subcontainers in closed condition.

29. The shipping and display container of claim 28 wherein the locking tabs are cut into the respective divider panels and further comprise a base tab with an enlarged locking tip formed at its distal end, and wherein said tab locking slots comprise a pair of slits formed in said top panel and juxtaposed adjacent to and on opposite sides of said line of severance.

* * * * *